United States Patent [19]

Isenberg et al.

[11] 4,043,383

[45] Aug. 23, 1977

[54] CONTINUOUS CASTING STARTING BAR AND STOWAGE THEREOF

[75] Inventors: Don Eugene Isenberg, Pittsburgh; Irvin Lee Parker, Jr., Coraopolis; Paul Allen Zelenski, Pittsburgh, all of Pa.

[73] Assignee: Koppers Company, Inc., Pittsburgh, Pa.

[21] Appl. No.: 725,729

[22] Filed: Sept. 23, 1976

[51] Int. Cl.[2] ..... B22D 11/08

[52] U.S. Cl. ..... 164/274

[58] Field of Search ..... 164/274, 82

[56] References Cited

U.S. PATENT DOCUMENTS

| | | | |
|---|---|---|---|
| 3,344,844 | 10/1967 | Reinfeld et al. | 164/274 |
| 3,433,287 | 3/1969 | Greenberger | 164/274 |
| 3,528,486 | 9/1970 | Golde | 164/274 |
| 3,608,619 | 9/1971 | Bollig | 164/274 |
| 3,930,533 | 1/1976 | Rokop et al. | 164/274 |

FOREIGN PATENT DOCUMENTS

| | | | |
|---|---|---|---|
| 1,950,772 | 4/1971 | Germany | |
| 1,205,888 | 9/1970 | United Kingdom | 164/274 |

*Primary Examiner*—Ronald J. Shore

*Attorney, Agent, or Firm*—R. Lawrence Sahr; Oscar B. Brumback

[57] ABSTRACT

An elongate rigid arcuate starting bar has a socket in a surface, and a dog that travels along a fixed arcuate track, under the influence of a fluid actuated cylinder-piston assembly, engages the starting bar socket and retracts the bar into a stowage therefor above a run-out table on which a continuous cast strand travels. The track is so shaped that the dog disengages from the starting bar, and also engages the starting bar automatically.

10 Claims, 9 Drawing Figures

CONTINUOUS CASTING STARTING BAR AND STOWAGE THEREOF

BACKGROUND OF THE INVENTION

1. Field of the Invention

The present invention pertains generally to continuous metal casting and, more particularly, to a starting bar and stowage of said starting bar.

2. Description of the Prior Art

U.S. Pat. No. 3,930,533 to Joseph Rokop et al. discloses a flexible starting bar for use in a continuous casting machine. While the starting bar of this patent is termed a "Flexible Elongate Starting Member Curved Lengthwise in a Vertical Plane", in reality it is known that the starting member can flex a small amount only in the direction toward its center of curvature; it cannot flex away from the center of curvature.

The flexible starting bar of U.S. Pat. No. 3,930,533 has a short length of rack that is pivotally secured to the outer convex surface of the portion of the bar near one end. The rack and the end portion of the bar coact with a pinion gear of a hoisting mechanism to move the bar upward to, and to keep and hold it in, a stowed position.

U.S. Pat. No. 3,433,287 discloses a dummy bar (starting bar) for a continuous casting machine that has a flexible end portion to which is attached a head piece; the remainder of the bar being arcuate and rigid. The bar is stowed in an arcuate trough, and the bar moves into and out of the stowed position by a coaction of powered pinch rolls with the bar.

U.S. Pat. No. 3,344,844 discloses an arcuate rigid starting bar that is moved into a stowed position by means of a hoisting winch and a wire rope or chain connected to the starting bar.

German Auslegeschrift 1.213.962 discloses a rigid starting bar that is equivalent to the starting bar of U.S. Pat. No. 3,344,844, insofar as the starting bar is hoisted into a stowed position by means of a powered winch with a wire rope or chain secured to one end of the starting bar.

DETAILED DESCRIPTION

Figure 1:
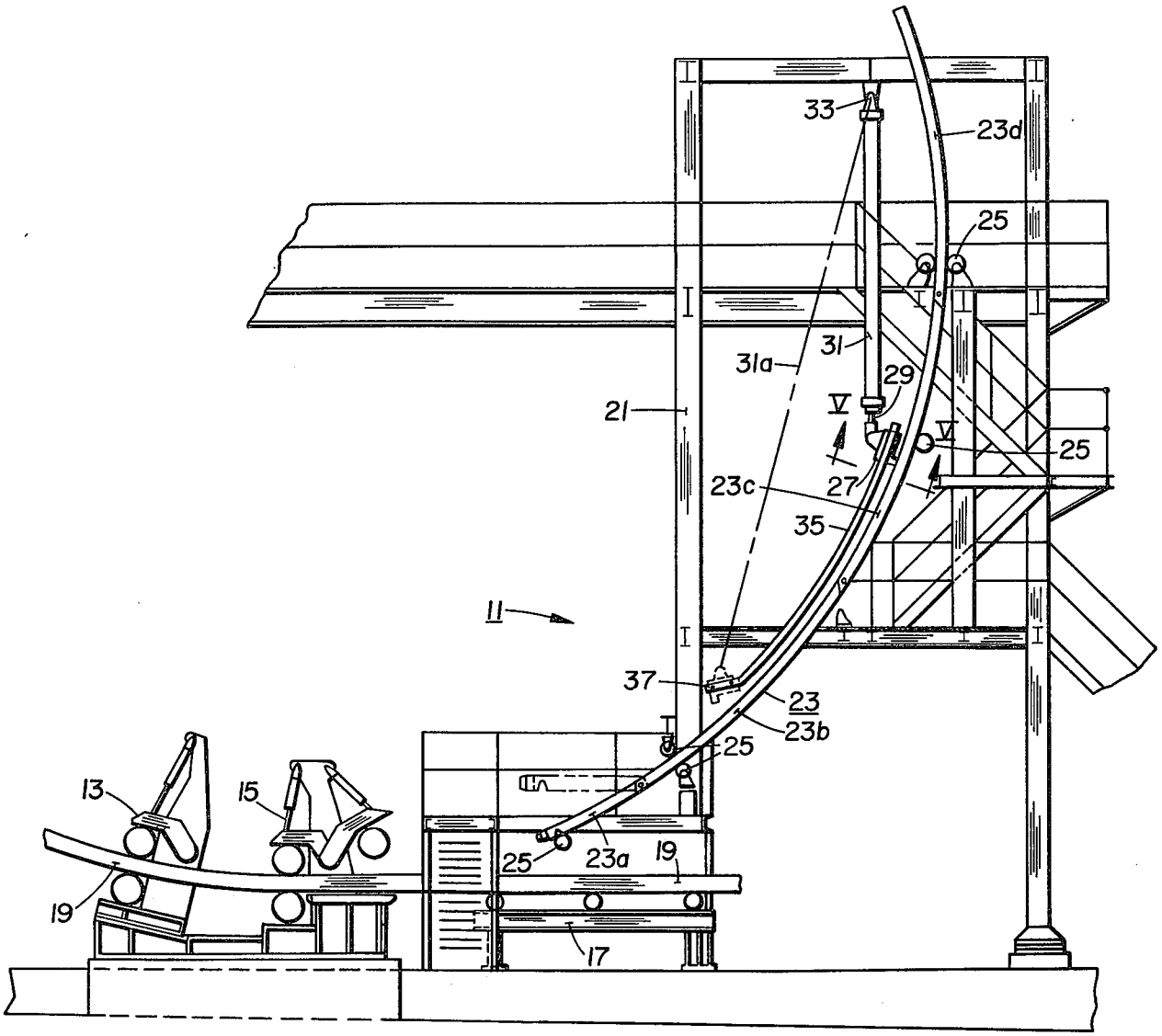
FIG. 1 is a schematic elevational view of a portion of a continuous metal casting machine incorporating an embodimentof the present invention.

Referring to FIG. 1, a portion of a continuous casting facility 11 is shown, and included are a set of powered pinch rolls 13; a cast strand straightener and disconnect apparatus 15; and a portion of a run-out table 17 on which a cast strand 19 is situated.

Adjacent the run-out table 17 is structure 21 supporting a segmental arcuate starting bar 23. The starting bar

23 is supported in the stowed position, where shown in FIG. 1, by a plurality of spaced apart rollers 25, and by a dog 27 engaging the bar; the dog being connected to a piston rod 29 of an elongate cylinder-piston assembly or actuating means 31. As shown, the cylinder-piston assembly or actuating means 31 is pivotally mounted to the structure, as at 33.

Figure 5:
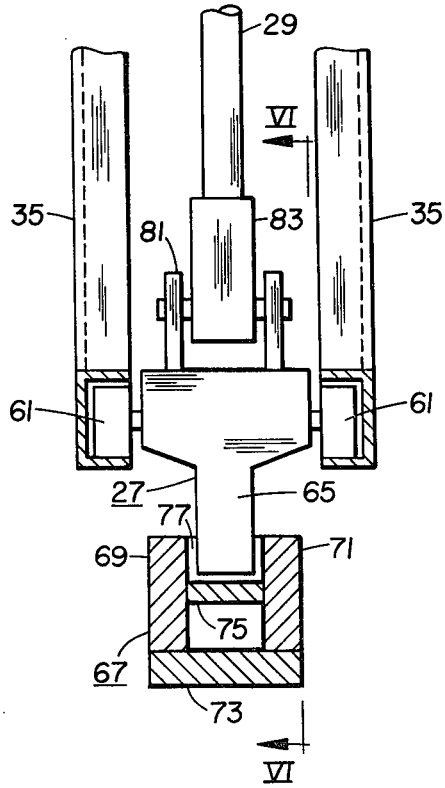
FIG. 5 is a view along the line V—V of FIG. 1, at an enlarged scale.

The dog coacts with an arcuate track comprising opposed channels, as shown in FIG. 5, that are arcuately parallel to the starting bar 23. The track 35 has a divergent lower end portion 37, that is fixed in relation to the starting bar 23 about as shown in FIG. 1. The starting bar 23 is comprised of a pivotable lower end portion 23*a* and three other segments 23*b*, 23*c* and 23*d* that, when joined together, form an arcuate rigid starting bar major portion.

FIGS. 2, 3, 4*a* and 4*b* illustrate a typical joint between segments of the starting bar 23. The segments of the starting bar 23 are I-beam shaped and each segment is fitted at the ends with a solid rectangular end piece and an end plate. The end plate is welded to the I-beam shaped segment and the end piece is bolted to the end plate.

In a typical joint shown in FIGS. 2, 3, 4*a* and 4*b*, segments 23*b* and 23*c* of the starting bar 23 are shown. Segment 23*b* is provided with end plate 38 and end piece 40, and segment 23*c* is provided with end plate 38*a* and end piece 42.

Figure 3:
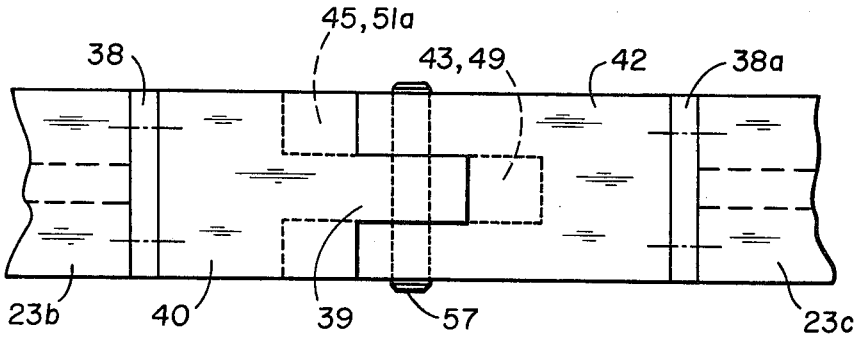
FIG. 3 is a plan view of the structure shown in FIG. 2.
Figure 2:
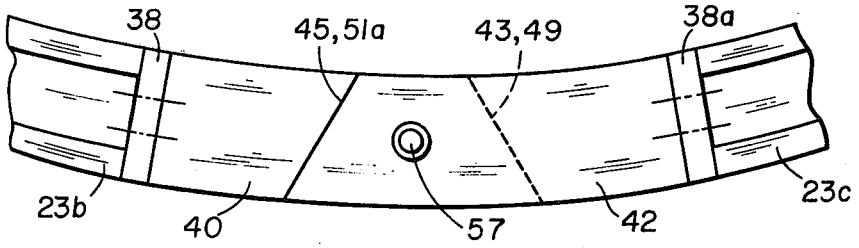
FIG. 2 is a view of a portion of the embodiment of the invention shown in FIG. 1.
Figure 4A:
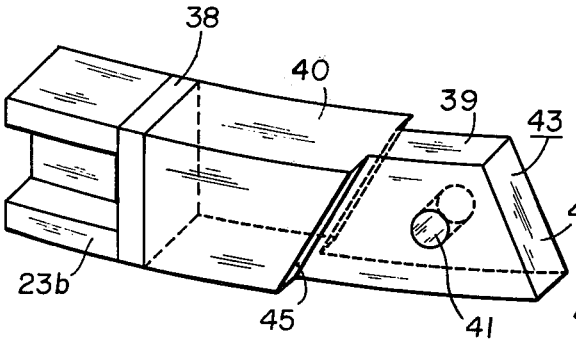
FIGS. 4*a* and 4*b* are perspective views of the structure of FIG. 2 when separated.
Figure 4B:
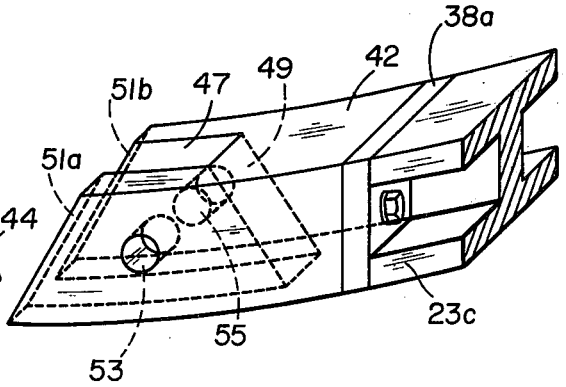

As shown in FIG. 3 and in FIGS. 4*a* and 4*b*, end piece 40 has a tongue 39 in which there is hole 41; the tongue 39 having a sloping front surface 43. The end piece 42 is a clevis having therein a slot 47 and axially aligned holes 53, 55 extending through the arms of the clevis 47. The end wall 49 of the clevis slopes at the same angle as the slope of th front surface 43 and these two surfaces 43, 49 coact when the segments 23*b*, 23*c* are joined together, as shown in FIGS. 2 and 3. A pin 57 extending through holes 53, 41 and 55 secure the two segments together. As shown, the front ends of the arms of the clevis have sloping surfaces 51*a*, 51*b* that coact with sloping surfaces 45 of the end piece 40, when the segments 23*b* and 23*c* are joined together.

Figure 6:
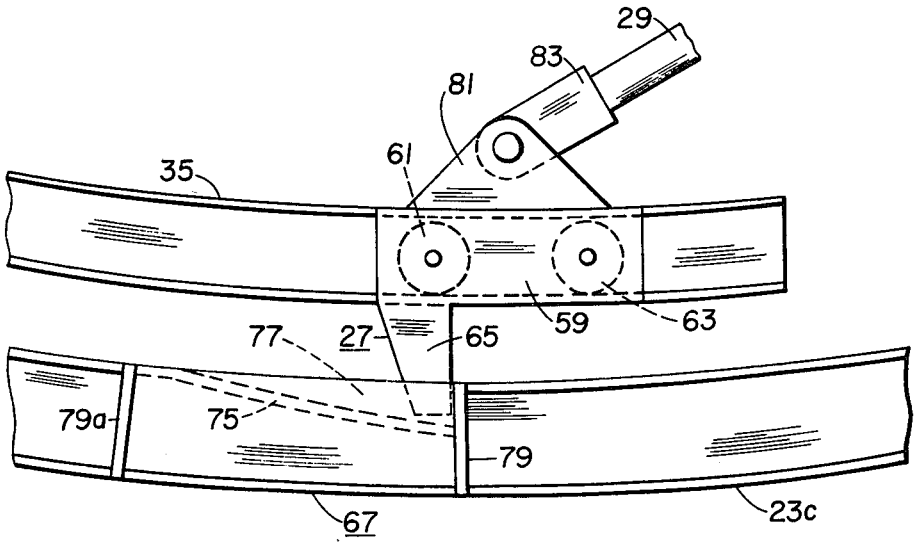
FIG. 6 is a view along line VI—VI of FIG. 5.

FIGS. 5 and 6 illustrate the dog 27 in cooperation with the segmented starting bar 23; particularly with the segments 23*c*. The dog 27 has a main body portion 59 that carries two sets of opposed rollers 61, 63. The rollers 61, 63 coact with the track 35 and follow the contour thereof; the track 35 being comprised of spaced apart facing arcuate channels.

Asshown in FIG. 6, the arcuate starting bar segment 23*c*, having an I-beam section as shown in FIGS. 4*a* and 4*b*, is provided with a grooved insert piece 67. The grooved insert 67 is a weldment having vertical side walls 69, 71 and a bottom 73. A sloping plate 75 is disposed between the vertical side walls 69, 71, forming a recess or groove 77.

The starting bar segment 23*c* is fitted with two end plates 79, 79*a*, like the end plates 38, 38*a* described previously herein, and the grooved insert 67 is bolt-connected or welded or secured thereto in any other suitable manner.

The dog 27 has a clevis-type bracket 81 on the top that cooperates with a tongue 83 fitted to the end of the piston rod 29, so that the dog 27 is movable by the cylinder-piston assembly 31 as described hereinafter.

Figure 7:
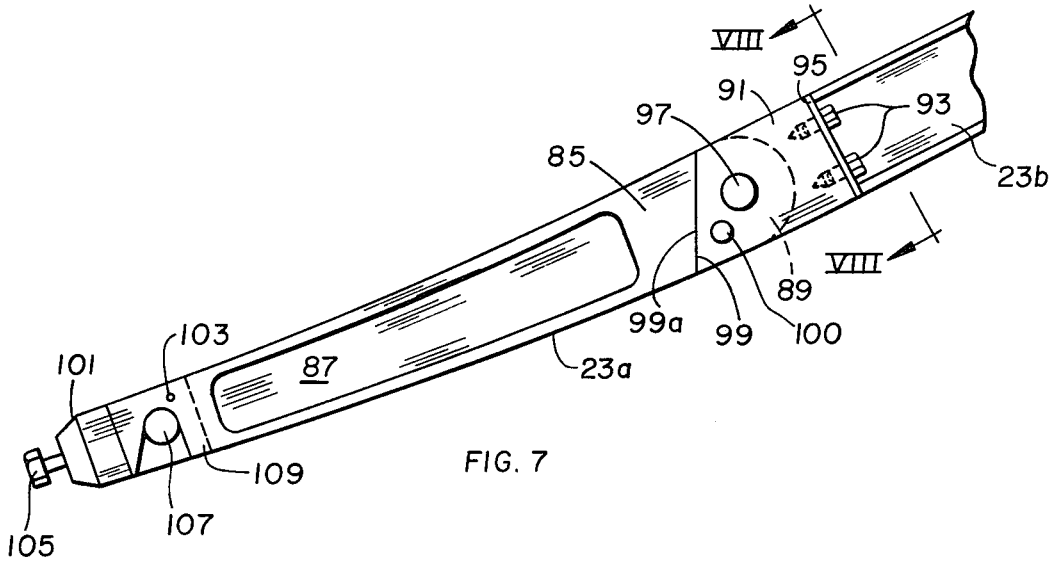
FIG. 7 is a view at an enlarged scale at a portion of the embodiment of the invention shown in FIG. 1.
Figure 8:
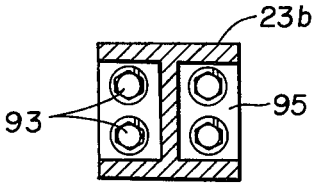
FIG. 8 is a view along line VIII—VIII of FIG. 7.

FIGS. 7 and 8 illustrate the pivotal lower end portion 23*a* of the starting bar 23. As shown in FIG. 7, the lower end portion 23*a* comprises an arcuate main body portion 85 having therethrough an elongate lightening hole 87 and at one end a tongue 89. The tongue 89 coacts with an end fitting 91 that is bolted, as shown at 93 in FIGS. 7 and 8, to an end plate 95 on the arcuate starting bar segment 23*b.* The end fitting 91 is in the form of a clevis having a slot therein into which tongue 89 fits and a pin 97, extending through the clevis and tongue, pivotally connects the arcuate lower end portion 23*a* to the arcuate segment 23*b.*

As shown in FIG. 7, the end fitting 91 has a sloping face 99 that coacts with a sloping face 99*a* on the main body portion 85, which coacting faces prevent the lower end portion 85 from pivoting downward as viewed in FIG. 7. The lower end portion 85 can, however, when a lock pin 100 is sheared or pulled out, pivot upwardly about pin 97, as suggested in FIG. 1, when urged to do so by upwardly moving roller 25, or the like.

When the lower end portion 85 is in the pivoted up position, shown in phantom in FIG. 1, a head end piece 101 may be added to the end of the lower end portion 85 and secured thereto by a shear pinn 103. The end piece 101 is conventional and includes a bolt 105 protruding from the tapered end portion and a pin 107 that coacts with a slot 109 on each side of the lower end portion 85.

In describing the operation of the present invention, it will be assumed that the cast strand 19 is moving from left to right, as viewed in FIG. 1. The arcuate starting bar 23 is stowed in position where shown, and is secured in such a position by the dog 27coacting with the bar segment 23*c,* annd more particularly, with the recess 77 and end plate 79 of the insert 67.

The lower end portion 23*a* of the starting bar has been fitted with a new detachable end piece 101 and the starting bar stands ready to be moved up into a casting mold (not shown) on the next cast.

When all is ready for the starting bar to move up toward the casting mold, the fluid-actuated cylinder-piston 31 is actuated so that the piston rod 29 extends downwardly (as shown in FIG. 1). As it moves downwardly, the starting bar 23 also moves downwardly. The pivotable lower end portion 23*a* enters the straightener 15 and the pinch rolls 13 which then urge the starting bar upwards towards the casting mold.

As the starting bar enters the straightener, the dog is diverted by the angularly disposed track 37 annd the dog 27 disengages from the insert piece 67, thereby freeing the starting bar from the dog. When the dog is in the extended position cooperating with the angularly disposed track 37, the cylinder-piston assembly extends along line 31*a,* shown in FIG. 1.

When the cast commences, as is conventional, the starting bar and the cast strand is withdrawn from the mold by the pinch rolls. The starting bar moves upwardly along an arc created by the support rollers 25, under the influence of the pinch rolls and the rolls of the straightener mechanism.

When the recess in segment 23*c* passes the dog 27, a switch (not shown) actuates a fluid circuit whereby the cylinder-piston is acuated and the dog is retracted along the arcuate track 35. The dog is retracted at a faster rate of speed than the speed of the starting bar. The dog then catches up with and engages the recess or groove in the bar segmment 23*c,* but the driving rolls overpower the fluid acting cylinder-piston assembly.

After the cast strand is separated from the starting bar in the usual manner, the fluid acting cylinder-piston then pulls the starting bar up into its stowed position, where shown in FIG. 1. The cast strand, in the usual manner, travels along the run-out table and is severed by a cut-off mechanism in the usual manner into billets of a desired length.

From the foregoing description of one embodiment of the invention, those skilled in the art should recognize many important features and advantages of it, among which the following are particularly significant:

That a starting bar in accordance with the present invention is less costly to manufacture and maintain since no carriage and mechanical drive mechanisms are required;

That the cylinder-piston type of drive is easier to repair and maintain;

That the alignment of a starting bar in accordance with the present invention is greatly improved; and That the structural support for a starting bar in accordance with the present invetion is simpler and less costly.

Although the invention has been described herein with a certain degree of particularity it is understood that the present disclosure has beenmade only as an example and that the scope of the invention is defined by what is hereinafter claimed.

We claim:

1. A continuous metal casting machine of the type including a mold from which a cast strand is withdrawn through powered pinch rolls and a strand straightener and disconnect apparatus, wherein the improvement comprises:

a. an arcuate starting bar adapted for sealing said mold and for connection to said cast strand;
b. means supporting said starting bar in a position adjacent said machine from which position said bar can move into operative association with said machine;
c. guide means disposed parallely to said arcuate starting bar in said position; and
d. bar actuating means cooperating with said guide means and carring means for moving said bar into and out of, and for holding said bar in, said position.

2. The invention of claim 1 wherein:

a. said starting bar is a jointed rigid structure; and
b. said bar has a head end portion that is pivotable only in a direction toward the center of curvature of said arcuate starting bar.

3. The invention of claim 1 wherein:

a. said guide means is an arcuate track that has an angularly divergent portion at one end of said track; and wherein
b. said means for moving and for holding said starting bar includes means connected to said actuating means that cooperates with said track and releasably engages said starting bar.

4. The invention of claim 3 wherein:

a. said means for moving said bar engages and holds said starting bar while said means traverses said arcuate track and releases said starting bar when said means traverses said angularly divergent portion.

5. The invention of claim 3 wherein:

a. said means for moving and holding said bar includes a member extending from said means that coacts with and urges said starting bar into and holds said bar in said stowed position.

6. A continuous metal casting machine of the type comprising a mold from which a strand is withdrawn through powered pinch rolls and a strand straightener and disconnect apparatus, wherein the improvement comprises:

a. an arcuate jointed rigid starting bar adapted for closing said mold and connecting to said strand, said starting bar cooperating with said pinch rolls and said straightener and disconnect apparatus as a means for withdrawing said strand from said mold;

b. structural means supporting said starting bar in a position adjacent said machine from which position said bar is movable into operative association with said machine;

c. an arcuate track mounted to said structural means and disposed parallely to said bar, said track having an end portion disposed angularly divergent away from said bar;

d. a dog movably mounted to said track having a dependent portion engageable with said bar for engaging said bar;

e. fluid actuated means mounted to said structural means and to said dog for moving said dog along said track including said angularly divergent portion thereof; and f. means for actuating said fluid actuated means whereby the dependent portion of said dog engages said bar and moves it when said dog travels along said arcuate track, and releases said bar when said dog travels along said angularly divergent portion of said track.

7. The invention of claim 6 wherein:

a. said arcuate starting bar has a head end portion that is pivotable only in the direction toward the center of curvature of said arcuate starting bar.

8. A continuous metal casting machine of the type comprising a mold from which a cast strand is withdrawn through powered pinch rolls and a strand straightener and disconnect apparatus, wherein the improvement comprises:

a. an arcuate starting bar comprising arcuate segments joined rigidly together by tongue and clevis with pin connection therethrough; and b. an arcuate end piece connected to one end of said bar so as to be pivotable only in the direction toward the center of curvature of said arcuate bar, and adapted for sealing mold and coacting with said cast strand.

9. A continuous metal casting machine of the type comprising a mold from which a cast strand is withdrawn through powered pinch rolls and a strand straightener and disconnect apparatus, wherein the improvement comprises:

a. an arcuate starting bar comprising arcuate segments releasably joined together and a pivotable head end portion adapted to close the bottom of said mold, said heating bar being inflexible; and b. a socket in a concave surface of said bar adapted to cooperate with means for moving said bar into and out of a position relative to said machine and for holding said bar in said position.

10. In a continuous metal casting machine of the type including a mold from which a cast strand is withdrawn through powered pinch rolls and a strand straightener and disconnect apparatus, a starting bar for withdrawing said cast strand from said mold comprising:

a. a plurality of arcuate segments secured together and forming said bar, whereby said bar is inflexible;

b. a head end portion secured to one end of said bar that is pivotable only in the direction toward the center of curvature of said arcuate starting bar, said head end portion being adapted for cooperation with and sealing said mold and for attachment to said cast strand;

c. a recess in a concave surface of said bar; and d. means cooperative with said recess for moving said bar along an arcuate path and for holding said bar in a stowed position relative to said machine.

* * * * *